US006206228B1

(12) United States Patent
Roth

(10) Patent No.: US 6,206,228 B1
(45) Date of Patent: Mar. 27, 2001

(54) DOUBLE-WALLED TANK FOR STORING FLUIDS SUCH AS HEATING-OIL, AND THE LIKE

(75) Inventor: Manfred Roth, Dautphetal (DE)

(73) Assignee: Roth Werke GmbH, Dautphetal (DE)

( * ) Notice: Subject to any disclaimer, the term of this patent is extended or adjusted under 35 U.S.C. 154(b) by 0 days.

(21) Appl. No.: 09/548,303

(22) Filed: Apr. 12, 2000

(30) Foreign Application Priority Data

Apr. 21, 1999 (DE) ..... 199 17 854

(51) Int. Cl.[7] ..... B65D 90/00
(52) U.S. Cl. ..... 220/601; 220/1.5; 220/4.13
(58) Field of Search ..... 220/615, 601, 220/567.2, 1.5, 4.12, 4.13

(56) References Cited

U.S. PATENT DOCUMENTS 3,437,231 * 4/1969 Carpenter, Jr. ..... 220/601
4,157,609 * 6/1979 Schutz ..... 220/1.5 X
4,173,288 * 11/1979 Schutz ..... 220/1.5
4,648,521 * 3/1987 Thomas et al. ..... 220/4.13 X
4,917,246 * 4/1990 Edelhoff ..... 220/1.5 X
5,201,437 * 4/1993 Burgdorf ..... 220/601
5,480,057 * 1/1996 Papaluca ..... 220/601 X

FOREIGN PATENT DOCUMENTS 1 960 889 6/1971 (DE) .
196 37 868 11/1997 (DE) .

* cited by examiner

*Primary Examiner*—Steven Pollard
(74) *Attorney, Agent, or Firm*—Collard & Roe, P.C.

(57) ABSTRACT

A double-walled tank for storing liquids, such as heating oil, diesel fuel and lubricating and hydraulic oils, with an inside container 1 made of plastic, and an outside container 2 made of steel sheet, the outside container being provided with a container cover 6. The container cover 6 contains openings for receiving sockets 7 of the inside container 1, and has a collar 8 with a U-shaped cross section. The collar is mounted on the top edge of the container jacket and solidly joined with container jacket 3. The interior space of the collar 8 contains a seal for sealing the collar gas-tight against the container jacket 3. Pressure rings for applying pressure to seals are threaded on sockets 7, and compress the seals between the cover and the container.

18 Claims, 3 Drawing Sheets

DOUBLE-WALLED TANK FOR STORING FLUIDS SUCH AS HEATING-OIL, AND THE LIKE

BACKGROUND OF THE INVENTION

1. Field of the Invention

This invention relates to a double-walled tank for storing fluids such as heating oil, diesel fuel, and lubricating and hydraulic oils, with an inside container made of plastic, and an outside container made of sheet steel. In the invention, the outside container is provided with a container cover having openings for receiving sockets of the inside container. The inside container is a plastic container, preferably produced by blow molding. The outside container has a mechanical protective function and, furthermore, protects against leakage if the inside container should leak.

The outside container has, for example, a container jacket consisting of a U-shaped jacket sheet forming the container bottom and two side walls, as well as two end sheets joined with the jacket sheet. The end sheets and the jacket sheet are connected either by welding, or by a flange joint along the longitudinal edges. However, the outside container may also consist of a bottom sheet and a single or multi-part jacket shaped in the form of a "U", whereby the bottom sheet and the jacket can be tightly flanged or welded together (See German patent DE-OS 1 960 889).

2. The Prior Art

In practice, the cover of the outer container is screwed or riveted to the container jacket, or retained on the latter by means of spring clamps. The openings that pass through the sockets or threaded pipes of the inside container are provided with a blind ring for visual correction, and prevent rain water from penetrating the openings. However, there is no gas or liquid tight encapsulation of the jacket space between the inside and outside container. The tanks with the design known from prior art practical applications can be combined in assemblies of up to 25 units, and set up for storing heating oil without a brickwork tub for quantities of up to 25 cubic meters at the most. In furnace rooms, the stored quantity may not exceed 5 cubic meters. In water protected areas and in locations where old oils are stored, the tanks must always be set up in a brickwork tub that is sealed by a suitable protective paint coating. For leakage monitoring, provision is made for a leakage sensor located between the inside and the outside containers, which is installed in the container cover (See German patent DE 196 37 868 C1).

SUMMARY OF THE INVENTION

The present invention provides an apparatus for reducing the risk of emissions for double-walled tanks in the event the inside container leaks, so that the tanks can be installed without a bottom tub under critical installation conditions. The invention thus provides a container cover that has a collar with a U-shaped cross section. The collar is mounted on the top edge of the container jacket and solidly joined with the latter. Moreover, the interior space of the collar contains a seal, to seal the collar gas-tight against the container jacket. Furthermore, pressure rings in the form of ring seals on thrust rings are arranged on the sockets or threaded pipes for applying pressure to the seals surrounding the sockets.

According to the invention, the jacket space between the inside container consisting of plastic, and the outside container produced from sheet steel, is encapsulated with liquid and is substantially gas-tight. The sheet steel elements of the outside container are preferably connected to each other in a form locked or closed way, and free of penetration. Galvanized, powder-coated or lacquered steel sheets can be used. Good protection against corrosion is assured because of the penetration-free connection technique.

According to a preferred embodiment of the invention, the outside container has both a U-shaped container jacket consisting of a jacket sheet forming the container bottom and two side walls, and two end sheets connected with the jacket sheet. The jacket sheet and the end sheets can be joined by welding the parts together. However, the sheets are preferably connected to each other by flanging them together. A seal is inserted in the flange connection, extending up to the top edge of the container jacket. The edges of the flanges flatly abut the container cover within the area of connection, and engage the collar of the container cover.

The collar of the container cover preferably contains a permanently elastic sealing compound. As an alternative, it is also possible to insert cord or strip-shaped seals, the latter assuring uninterrupted sealing between the container cover on the one hand, and the container jacket on the other.

According to a preferred embodiment of the invention, the leg of the container collar abutting the inner side of the container jacket is wider than the section of the collar abutting the outer side of the container jacket. Moreover, the container jacket is connected with the leg of the collar located on the inner side of the container by means of identical, perforation-free deformations of the steel sheets. The edge enveloping the container jacket on the outer side is preferably folded over toward the container jacket in the form of a flanged edge to protect the seal and to eliminate any possible risk of injury.

The seals associated with the sockets can be disposed between the container cover and the inside container, or may extend around the edges of the holes in the container cover in a U-shaped form. The sockets are preferably threaded sockets to receive corresponding threaded thrust rings.

According to another embodiment of the invention, a device for monitoring leakage is connected to the jacket space between the inside and outside containers. The device is connected to a vacuum pump, and has a suction line extending into the lower zone of the jacket space, as well as a measuring line for measuring the pressure. In the event that the inside or outside container leaks, the vacuum collapses, and the leakage is indicated visually and/or acoustically. The blow-molded plastic inside container has only low dimensional stability, so that the static pressure of the stored fluid and the vacuum prevailing in the jacket space may cause the inside container to be forced against the surface of the wall of the outside container. In order to assure that the entire jacket space is reliably monitored for leakage, a layer permeable to gas is disposed between the inside container and the outside container to prevent the inside container from flatly abutting the jacket of the outside container. The same effect can be obtained if the outer surface of the inside container has a surface structure consisting of point-like dimple projections, or line-shaped elevations or ridges.

If the double-walled tank is set up in areas where flooding may occur, it is necessary to prevent the tank, from floating upward when acted upon by the buoyant force of water. According to the invention, the tank can be secured against floating by affixing claws to the container cover in the corner areas, which are clamped against the container cover by means of tension rods anchored in the floor of the storage facility.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
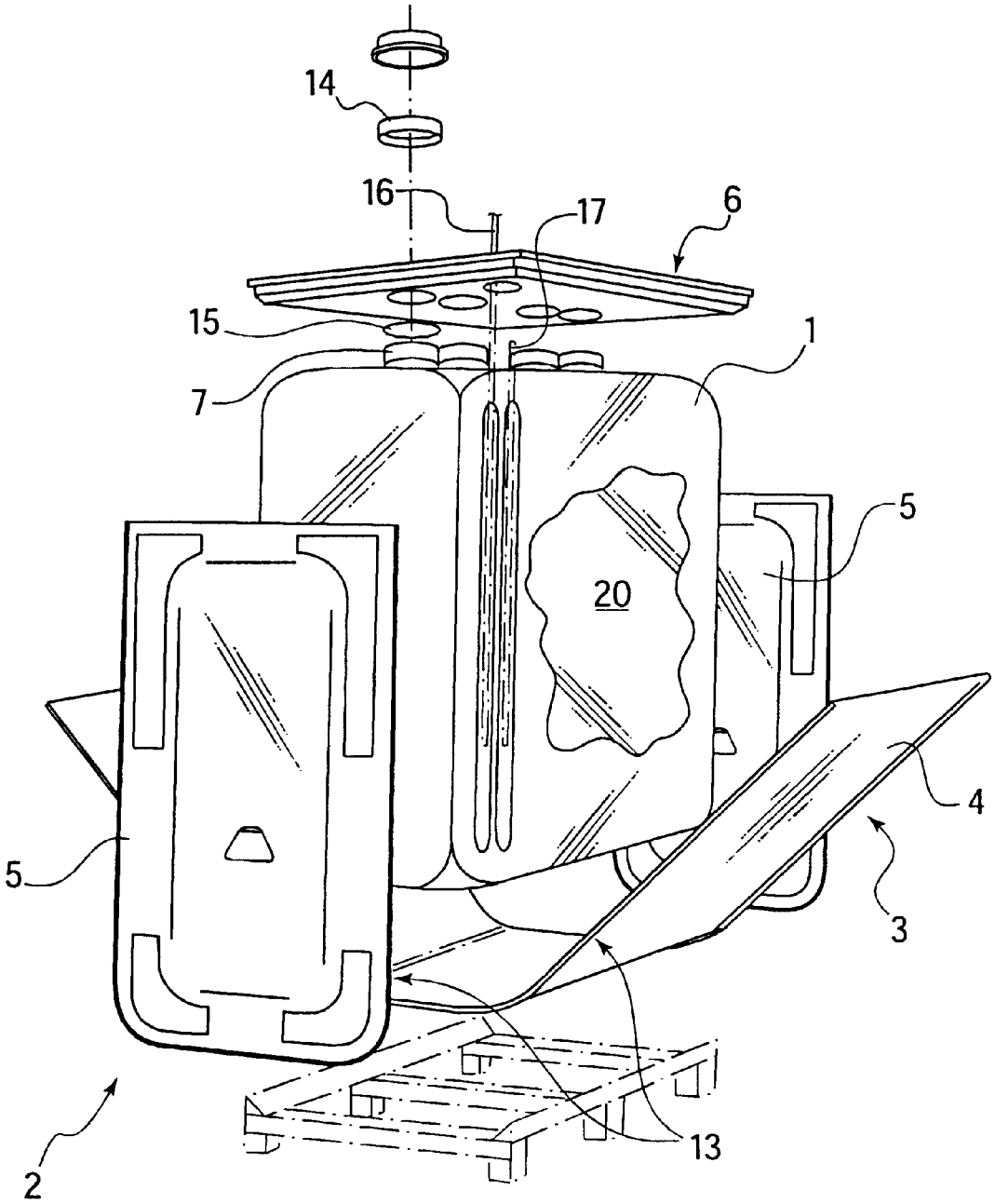
FIG. 1 shows an exploded view of the basic structure of the double-walled tank as defined by the invention.

Referring to FIG. 1, the double-walled tank is especially designed for storing heating oil, diesel fuel, and lubricating and hydraulic oils. In its basic structure, the tank consists of an inside container 1 of plastic produced by blow molding, and an outside container 2 made of galvanized sheet steel, or sheet steel protected against corrosion in some other way. The outside container 2 consists of a container jacket 3 made of a U-shaped jacket sheet 4 forming the container bottom and two side walls, as well as two end sheets 5 connected with the jacket sheet 4. Furthermore, outside container 2 is provided with a container cover 6, which contains openings for passing through the threaded pipes, nipples or sockets 7 of inside container 1. Threaded pipes, nipples or sockets 7 are used to fill or ventilate inside container 1.

Figure 2:
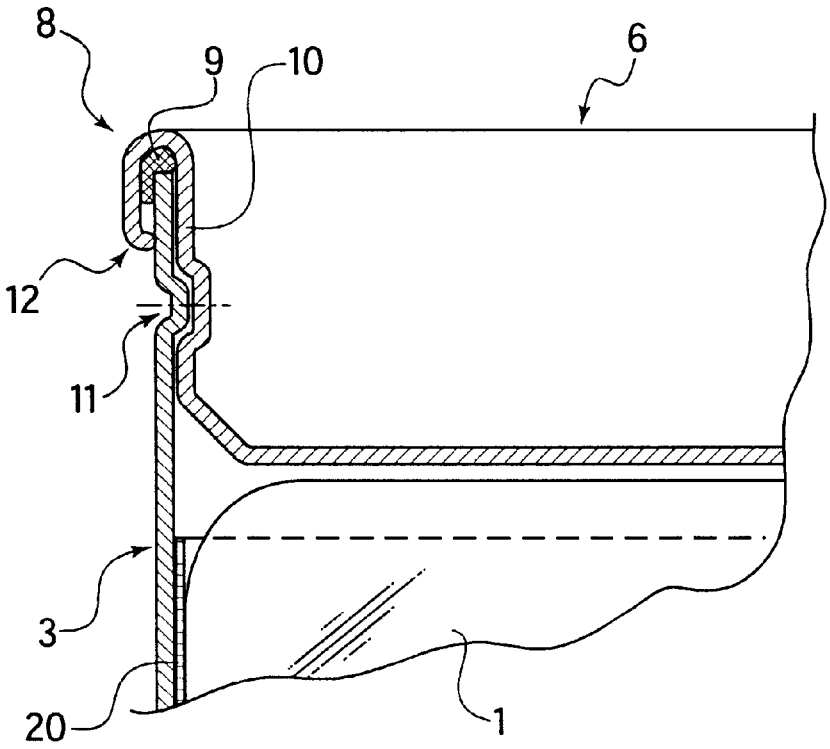
FIG. 2 shows an enlarged cross section of the area where the tank of FIG. 1 is connected with the cover.

FIG. 2 shows in detail that container cover 6 has a collar 8 with a U-shaped cross section. Collar 8 is mounted on the top edge of container jacket 3, and solidly joined with the latter. The interior space of collar 8 contains a seal 9, which seals the collar gas-tight against the container jacket. Seal 9 consists of a permanently elastic sealing compound. FIG. 2 shows, furthermore, that a leg 10 of collar 8 abutting the inner side of container jacket 3 is wider than the section of collar 8 abutting the outer side of the container jacket. Container jacket 3 is connected with leg 10 located on the inner side of the container, point by point through the formlocking, penetration-free deformations 11 of the steel sheet. The connections can be produced either without or with auxiliary rivets such as blind plugs or stamping rivets, which, preferably, do not penetrate the sheets. The edge of the container cover is folded over toward the container jacket 3, on the outer side, forming a flanged edge 12. Sealing compound 9 is largely protected in this way from the outer side. Flanged edge 12 is smooth, and serves to prevent injury to the user.

The U-shaped jacket sheet 4, and end sheets 5 are connected to each other on their longitudinal edges by the flanging 13 as shown in FIG. 1. A seal is inserted in the flanged joint, which extends up to the top edge of container jacket 3. Within the connection zone of container cover 6, the edges of the flanged joint flatly abut the container jacket 3 and engage collar 8 of container cover 6.

Figure 3:
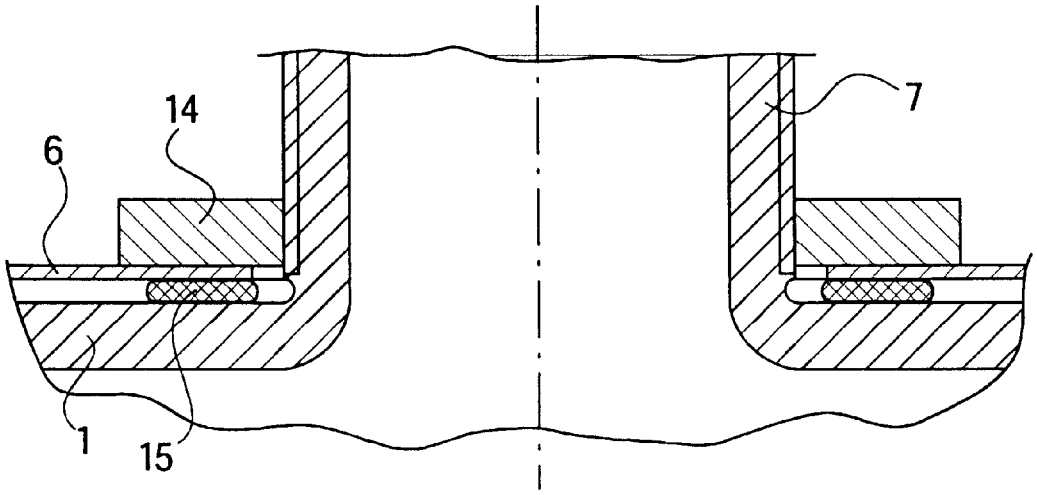
FIG. 3 shows an enlarged cross section of the socket or pipe area of the tank of FIG. 1.

As shown in FIG. 3, pressure rings 14 are disposed on the threaded sockets 7 of inside container 1. Pressure rings 14 press container cover 6 against elastic seals 15, which are arranged between container cover 6 and inside container 1, and surround sockets 7. Seals 15 are in the form of rings that are compressible when pressure rings 14 are tightened down on sockets 7.

The jacket space between inside container 1 and the outside container 2 is liquid-tight and largely encapsulated and gas-tight. Thus, in the event of any leakage of inside container 1, no stored fluid can leak into the environment even under critical installation conditions. The encapsulation of the jacket space as defined by the invention also prevents gaseous emissions of organic substances, which enter the jacket space by diffusion through the thin-walled inside container 1. This also eliminates odors caused by organic fluids that may be stored in the plastic containers, where components of the fluids can diffuse outwards through the container wall.

Figure 4:
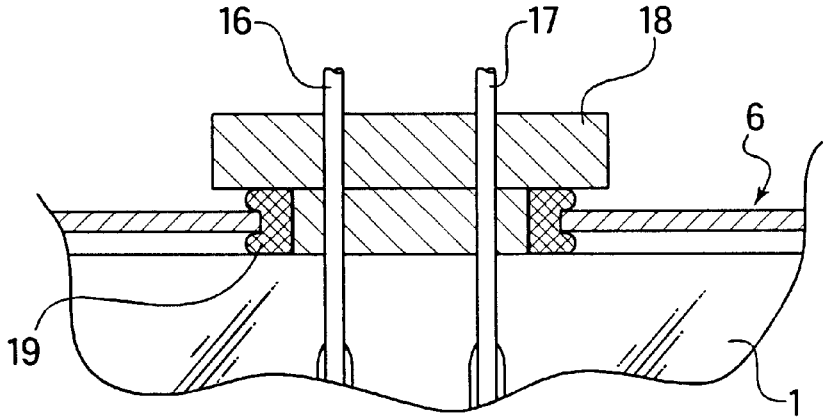
FIG. 4 shows a cross sectional view through a measuring socket adjoining the jacket space of the tank of FIG. 1.

As shown in FIG. 4, there is provided a device for monitoring leakage, connected to the jacket space between inside container 1 and outside container 2. The monitoring device has a suction line 16, which is connected to a vacuum pump (not shown) and leads into the lower zone of the jacket space. Moreover, there is a measuring line 17 for measuring the pressure. The measuring socket 18, through which measuring line 17 and suction line 16 are installed, is sealed against container cover 6 by a sealing sleeve 19. Since the diameter of measuring socket 18 is relatively small, sealing measures requiring greater expenditure in cost as those shown in FIG. 3 are generally not needed.

A support layer 20, shown in FIG. 1, which is permeable to gas, is disposed in the jacket space between inside container 1 and outside container 2. Support layer 20 prevents inside container 1 from flatly abutting the container jacket of outside container 2. Instead of using a support layer 20, for example in the form of a fabric, a bubble foil, foam plastic and the like, the spacing required between the inside container 1 and the outside container 2 for leakage monitoring can also be provided by using ridges on dotted profiles, formed on the outer surface of inside container 1, which will maintain the spacing between the two containers when the inside container is filled.

Figure 5:
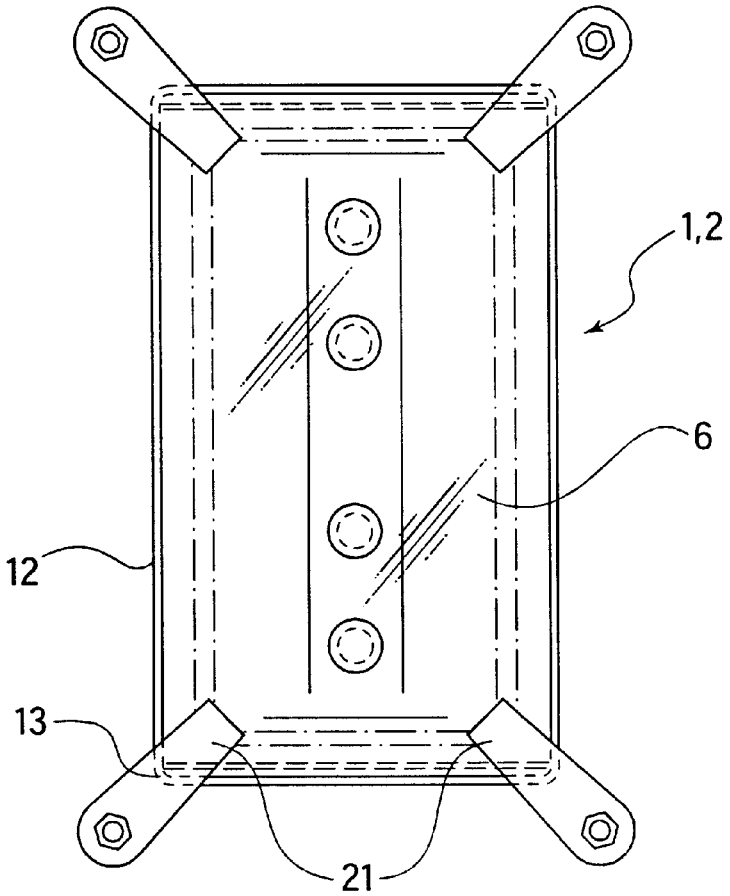
FIG. 5 is a top view of the tank of the invention, with an additional anchoring shown on the bottom side, for installing the tank in an area exposed to the danger of flooding.

If the tank is installed in regions which are considered as flood areas, it has to be secured against floating, so that in case of flooding of the bottom area, it will not float up under the buoyant force acting on the tank. In FIG. 5, the tank is secured with claws 21 resting on container cover 6. The claws are disposed in the corner areas, and can be clamped against the container cover with tension rods (not shown) anchored in the floor of the storage room.

Inside container 1 may also be constructed of other materials that are impervious to petroleum products, such as fiberglass. Seals 15 and 19 may be constructed of neoprene, or of a compressible plastic material that is impervious to the fluids of the inside container.

Accordingly, while only a few embodiments of the present invention have been shown and described, it is obvious that many changes and modifications may be made thereunto without departing from the spirit and scope of the invention.

What is claimed is:

1. A double-walled tank for storing fluids such as heating oil, diesel fuel and lubricating and hydraulic oils, with an inside container 1 made of a plastic material, and having inlet and outlet sockets 7, and an outside container made of a sheet-metal, whereby the outside container 2 defines a container jacket 3 having an exposed top edge, comprising;

a) a container cover 6 having along its periphery a collar 8 with a U-shaped cross section, said collar being mounted on the top edge of container jacket 3 so that the U-shaped collar encloses the top edge of container jacket 3, said cover 6 having openings for receiving sockets 7;

b) a seal 9 disposed in the interior space of said collar 8 for sealing said collar 8 gas-tight against container jacket 3, seals 15 surrounding said sockets and disposed between said cover 6 and inside container 1; and c) pressure rings 14 coupled to sockets 7 for applying compressive pressure to seals 15, said pressure rings surrounding sockets 7 in the form of rings.

2. The double-walled tank according to claim 1, wherein outside container 2 has a container jacket 3 consisting of a U-shaped jacket sheet 4 forming the container bottom and two side walls, and two end sheets 5 connected with jacket sheet 4.

3. The double-walled tank according to claim 2, further comprising;

a) a flange connection 13 for connecting said U-shaped jacket sheet 4 and end sheets 5 together; and b) a seal inserted in said flange connection 13, said seal extending up to the top edge of container jacket 3, and whereby the edges of the flange flatly abut the container jacket 3 in the connection zone of the container cover, and engage said collar 8 of said container cover 6.

4. The double-walled tank according to claim 1, wherein outside container 2 is made of a lacquered, powder-coated sheet steel.

5. The double-walled tank according to claim 1, wherein outside container 2 is made of a galvanized sheet steel.

6. The double-walled tank according claim 1, wherein said seal 9 comprises a permanently elastic sealing compound disposed within said collar 8 to seal said cover 6 to container 3.

7. The double-walled tank according to claim 1, wherein said collar 6 has a leg 10 abutting the inner side of container jacket 3 that is wider than the section of said collar 8 abutting the outer side of container jacket 3, said leg 10 including an indented portion and a point-like, penetration-free deformation portion 11 formed in the container jacket 3 and nested in the indented portion of leg 10.

8. The double-walled tank according to claim 1, wherein the edge of the U-shaped collar 8 of container cover 6 gripping over the edge of container jacket 3 on its outer side is folded over toward the container jacket defining a flanged edge 12.

9. The double-walled tank according to claim 1, wherein said seals associated with the sockets 7 are U-shaped in cross section and are disposed around the edges of the holes in said container cover 6 and in contact with inside container 1.

10. The double-walled tank according to claim 1, comprising a leakage monitoring device connected to the jacket space between inside container 1 and outside container 2, said monitoring device having a suction line 16 for connection with a vacuum pump and extending into the lower zone of the jacket space, and a measuring line 17 for measuring the pressure within the jacket space.

11. The double-walled tank according to claim 1, further comprising a support layer 20 permeable to gas disposed in the jacket space between inside container 1 and outside container 2, said support layer preventing the inside container 1 from flatly abutting the container jacket of outside container 2.

12. The double-walled tank according to claim 1, wherein the outer surface of inside container 1 has a surface structure consisting of point-like dimple elevations preventing inside container 1 from flatly abutting container jacket of the outside container 2.

13. The double-walled tank according to claim 1, wherein the outer surface of inside container 1 has a surface structure consisting of linear-shaped ridges preventing inside container 1 from flatly abutting container jacket of the outside container 2.

14. The double-walled tank according to claim 1, further comprising claws 21 coupled to said container cover 6, said claws being arranged in the corner areas and fixable as clamps against said container cover 6 for connection with tension rods.

15. A double-walled tank for storing fluids such as heating oil, diesel fuel and lubricating and hydraulic oils, with an inside container 1 made of a plastic material, and having inlet and outlet sockets 7, and an outside container made of a sheet-metal, whereby the outside container 2 defines a container jacket 3 having an exposed top edge, comprising;

a) a container cover 6 having along its periphery a collar 8 with a U-shaped cross section, said collar being mounted on the top edge of container jacket 3 so that the U-shaped collar encloses the top edge of container jacket 3, said cover 6 having openings for receiving sockets 7; and b) a seal 9 disposed in the interior space of said collar 8 for sealing said collar 8 gas-tight against container jacket 3.

16. The double-walled tank according to claim 15, further comprising seals 15 surrounding said sockets and disposed between said cover 6 and inside container 1.

17. The double-walled tank according to claim 16, further comprising pressure rings 14 coupled to sockets 7 for applying compressive pressure to seals 15, said pressure rings surrounding sockets 7 in the form of rings.

18. The double-walled tank according to claim 15, wherein said collar 8 has a leg 10 abutting the inner side of container jacket 3 that is wider than the section of said collar 8 abutting the outer side of container jacket 3, said leg 10 including an indented portion, and a penetration-free deformation portion 11 formed in the container jacket 3 and nested into the indented portion of leg 10.

* * * * *